US007561013B2

(12) United States Patent
Yoneyama et al.

(10) Patent No.: US 7,561,013 B2
(45) Date of Patent: Jul. 14, 2009

(54) SMALL NRD GUIDE BEND

(75) Inventors: Tsukasa Yoneyama, Sendai (JP); Hirokazu Sawada, Sendai (JP)

(73) Assignee: Intelligent Cosmos Research Institute, Sendai-Shi (JP)

( * ) Notice: Subject to any disclaimer, the term of this patent is extended or adjusted under 35 U.S.C. 154(b) by 157 days.

(21) Appl. No.: 10/547,287

(22) PCT Filed: Feb. 5, 2004

(86) PCT No.: PCT/JP2004/001167

§ 371 (c)(1),
(2), (4) Date: Jun. 5, 2006

(87) PCT Pub. No.: WO2004/077602

PCT Pub. Date: Sep. 10, 2004

(65) Prior Publication Data

US 2006/0255889 A1 Nov. 16, 2006

(30) Foreign Application Priority Data

Feb. 26, 2003 (JP) ..... 2003-049953

(51) Int. Cl.
*H01P 1/02* (2006.01)
*H01P 1/162* (2006.01)
*H01P 5/18* (2006.01)

(52) U.S. Cl. ..... 333/249; 333/251; 333/113

(58) Field of Classification Search ..... 333/239, 333/248, 249, 251, 113
See application file for complete search history.

(56) References Cited

U.S. PATENT DOCUMENTS

| | | | | |
|---|---|---|---|---|
| 5,666,094 | A * | 9/1997 | Kato et al. | 333/248 |
| 5,781,086 | A * | 7/1998 | Kato et al. | 333/248 |
| 5,982,255 | A * | 11/1999 | Tanizaki et al. | 333/239 |
| 6,832,081 | B1 * | 12/2004 | Hiramatsu et al. | 455/328 |
| 2001/0049266 | A1 * | 12/2001 | Hayata et al. | 455/81 |

FOREIGN PATENT DOCUMENTS

| | | |
|---|---|---|
| JP | 5-206708 | 8/1993 |
| JP | 8-8621 | 1/1996 |
| JP | 11-191706 | 7/1999 |
| JP | 11-308014 | 11/1999 |
| JP | 2000-59103 | 2/2000 |
| JP | 2002-76776 | 3/2002 |
| JP | 2003-198216 | 7/2003 |
| JP | 2004-504746 | 2/2004 |
| WO | WO 02/07251 | 1/2002 |

* cited by examiner

*Primary Examiner*—Benny Lee
(74) *Attorney, Agent, or Firm*—Young & Thompson

(57) ABSTRACT

An LSE mode, which is a parasitic mode, can be effectively suppressed by a simple structure, and a reduction in size and weight can be thereby facilitated. Further, a metal body 3 is arranged in the vicinity of a dielectric waveguide 1 of an NRD guide to suppress the LSE mode, the NRD guide being configured to propagate electromagnetic waves through the dielectric waveguide 1 which is sandwiched between parallel conductor plates with a gap of less than a ½ wavelength. This metal body 3 has an arbitrary shape, and may have a discoid shape, an elliptic shape or a prismatic shape. Furthermore, an even distance d is maintained between the metal body 3 and the dielectric waveguide 1, and a phase constant difference can be suppressed by changing this distance d.

9 Claims, 9 Drawing Sheets

SMALL NRD GUIDE BEND

TECHNICAL FIELD

The present invention relates to an NRD guide bend capable of transferring with suppression of an electromagnetic field of an LSE mode which is a parasitic mode in an NRD guide (Nonradiative Dielectric Wave Guide) as an elemental technology realizing ultrahigh-speed/high-capacity wireless communication, and more particularly to an NRD guide bend for a millimeter-wave band.

BACKGROUND ART

In recent years, there have been proposed a wide variety of broadband circuit elements each of which is available for the realization of ultrahigh-speed/high-capacity wireless communication device. In particular, development of a broadband circuit element which covers the 59 to 66 GHz band is important. With this development, it is possible to realize an ultrahigh-speed wireless LAN, a home link, cable TV wireless transfer, an inter-vehicle communication system and other applications at a transmission rate exceeding, e.g., 400 Mbps.

As such a millimeter-wave or microwave transmission circuit, an NRD guide has been conventionally used (see JP-A-2000-341003). In this NRD guide, as shown in FIG. 17(*a*), a dielectric waveguide 101 formed of, e.g., Teflon® (registered trademark for polytetrafluoroethylene) having, e.g., a dielectric constant $\in r=2.04$ is provided between a pair of parallel conductor plates 102*a* and 102*b*. A width of each of these conductor plates 102*a* and 102*b*, i.e., a height of the dielectric waveguide 101 is set to be less than a ½ wavelength of a frequency of an electromagnetic wave propagated through this dielectric waveguide 101, and a width of the dielectric waveguide 101 is set to be approximately a ½ wavelength. For example, if an operating frequency is 60 GHz, a height of the dielectric waveguide 101 is set to 2.25 mm and a width of the dielectric waveguide 101 is set to 2.5 mm. As a result, an electromagnetic wave having the operating frequency can be propagated through the dielectric waveguide 101, but the electromagnetic wave having the operating frequency cannot be propagated outside the dielectric waveguide 101 in a widthwise direction of the dielectric waveguide 101, and hence the electromagnetic wave having the operating frequency is trapped in and transmitted through the dielectric waveguide 101.

Although an electromagnetic field in a cross section is generated in an operating mode (an LSM mode) of the electromagnetic wave having the operating frequency transmitted through this dielectric waveguide 101 as shown in FIGS. 17(*a*) and 17(*b*), an LSE mode which is an unnecessary parasitic mode is produced due to bending or branching of the dielectric waveguide 101 as shown in FIG. 17(*b*).

In order to suppress this LSE mode, a mode suppressor 103 having a ¼ wavelength choke configuration is inserted into the dielectric waveguide 101 in the prior art as shown in FIG. 18.

SUMMARY OF THE INVENTION

In the producing process, the dielectric waveguide 101 is firstly divided into two portions in a longitudinal direction. The portions of the dielectric waveguide 101 are then adhesively-connected to each other after the above-described conventional mode suppressor 103 is inserted between the portions of the dielectric waveguide 101. The above-described conventional mode suppressor encounters a problem resulting from the time-consuming and complicated producing process.

In view of the above-described problems, it is an object of the present invention to provide a small NRD guide bend (an NRD guide mode suppressor) which has a simple configuration and can effectively suppress an LSE mode which is a parasitic mode.

To this end, a small NRD guide bend according to claim 1 is characterized in that a conductor is arranged in the vicinity of a dielectric waveguide of an NRD guide which propagates an electromagnetic wave through the dielectric waveguide, the dielectric waveguide being sandwiched between parallel conductor plates and having a gap which is less than a ½ wavelength.

According to the invention, it is possible to effectively suppress an LSE mode which is an unnecessary parasitic mode by simple external arrangement, i.e., arranging the conductor in the vicinity of the dielectric waveguide of the NRD guide which transmits an electromagnetic wave by using the dielectric waveguide which is sandwiched between the parallel conductor plates and has a gap which is less than a ½ wavelength.

Further, in the above-described invention, the small NRD guide bend is characterized in that the conductor is a housing of an apparatus including the NRD guide.

Furthermore, in the above-described invention, the small NRD guide bend is characterized in that the conductor is provided in the vicinity of a directional coupler formed of dielectric waveguides which are in proximity to each other and bent.

Moreover, in the above-described invention, the small NRD guide bend is characterized in that the conductors are provided along the dielectric waveguide at equal intervals in proximity to each other, a curvature radius of a bending portion of the dielectric waveguide is arbitrary, and an amplitude of the electromagnetic wave propagated through the dielectric waveguide is determined based on an angle of the bending portion.

Additionally, in the above-described invention, the small NRD guide bend is characterized in that a distance between the dielectric waveguide and the conductor is changed to adjust a phase constant difference of the electromagnetic wave propagated through the dielectric waveguide.

Further, in the above-described invention, the small NRD guide bend is characterized in that a distance between the dielectric waveguide and the conductor is approximately 0.5 mm.

Furthermore, in the above-described invention, the small NRD guide bend is characterized in that the conductor has a rod-like shape, and a length of the metal body is changed to vary a suppressed frequency of a parasitic mode generated in the dielectric waveguide.

Moreover, in the above-described invention, the small NRD guide bend is characterized in that the dielectric waveguide forms a bending portion of approximately 180 degrees, the conductor is provided on an inner side of the bending portion, and a curvature radius of the conductor is changed to vary a suppressed frequency of a parasitic bend generated in the dielectric waveguide.

As described above, according to the present invention, it is possible to demonstrate an advantage of enabling effective suppression of the LSE mode which is an unnecessary parasitic mode by using only a simple external arrangement, i.e., arranging the conductor in the vicinity of the dielectric waveguide of the NRD guide which transmits an electromagnetic wave through the dielectric waveguide which is sandwiched between the parallel conductor plates and has a gap which is less than a ½ wavelength.

Additionally, according to the present invention, by providing the conductor as a housing of an apparatus including the NRD guide, effects and advantages of both a housing function and a mode suppressing function can be obtained, thereby demonstrating an advantage of facilitating a reduction in size and weight.

Further, according to the present invention, by providing the conductor in the vicinity of a directional coupler formed by the dielectric waveguides which are in proximity to each other and bent, a bending radius of each bending portion can be reduced, whereby the direction coupler which is small in size and weight can be advantageously obtained.

Furthermore, according to the present invention, conductors are provided at equal intervals along the dielectric waveguide in proximity to each other, the bending portion of the dielectric waveguide has an arbitrary curvature radius, and an amplitude of an electromagnetic wave propagated through the dielectric waveguide is determined based on an angle of the bending portion, thereby advantageously assuredly reproducing the LSM mode.

Moreover, according to the present invention, since a phase constant difference of an electromagnetic wave propagated through the dielectric waveguide is adjusted by changing a distance between the dielectric waveguide and the conductor, the bending portion having an arbitrary bending angle can be obtained, and an advantage of realizing the flexible NRD guide can be demonstrated.

Additionally, according to the present invention, a phase constant difference of the NRD guide having a standard shape can be set to 0 by determining a distance between the dielectric waveguide and the conductor as approximately 0.5 mm, and the advantage of reproducing the LSM mode at an output port of a bend can be thereby obtained.

Further, according to the present invention, the conductor has a rod-like shape, a suppressed frequency of the parasitic mode generated in the dielectric waveguide is changed by varying a length of the metal body, or the dielectric waveguide forms the bending portion of approximately 180 degrees, the conductor is provided on the inner side of the bending portion, and a curvature radius of the conductor is changed to vary the suppressed frequency of the parasitic mode generated in the dielectric waveguide, thereby obtaining an advantage of effectively suppressing an operating frequency as a suppression target.

DESCRIPTION OF REFERENCE NUMERALS

1, 11, 21, 22, 31, 61 dielectric waveguide
2*a*, 2*b* conductor plate
3, 13, 23, 33, 43, 53, 63 metal body
4 housing
P1 to P4 port

BEST MODE FOR CARRYING OUT THE INVENTION

Preferred embodiments of an NRD guide mode suppressor according to the present invention will now be described in detail hereinafter with reference to the accompanying drawings.

EMBODIMENTS

Embodiment 1

Figure 1:
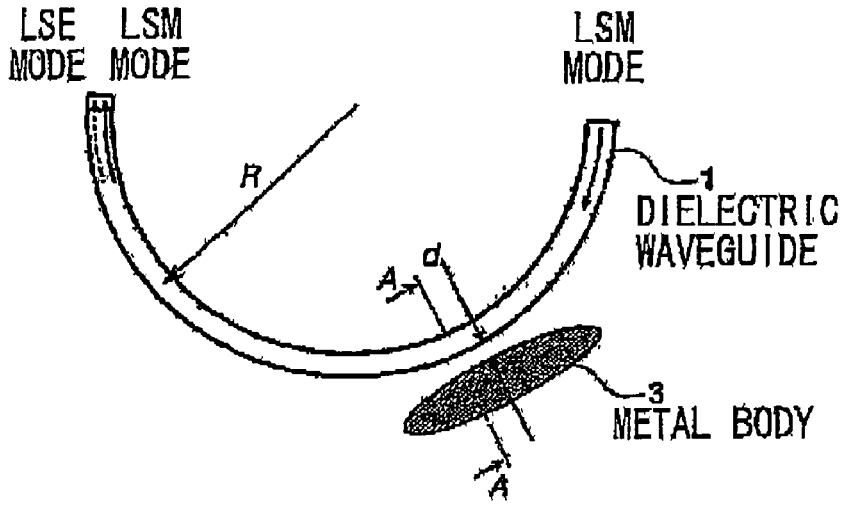
FIG. 1 is a schematic view showing a configuration of an NRD guide mode suppressor which is Embodiment 1 according to the present invention.
Figure 2:
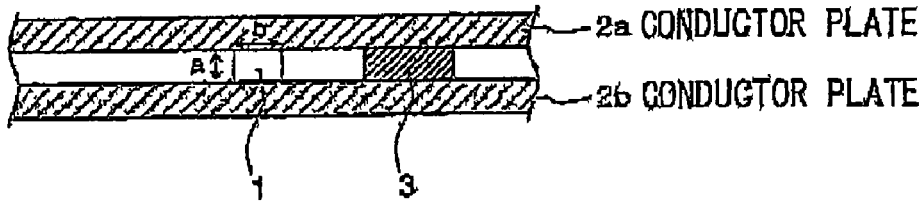
FIG. 2 is a cross-sectional view of the NRD guide mode suppressor depicted in FIG. 1 taken along a line A-A.

FIG. 1 is a schematic view showing a configuration of an NRD guide mode suppressor which is Embodiment 1 according to the present invention. Further, FIG. 2 is a cross-sectional view of the NRD guide mode suppressor depicted in FIG. 1 taken along a line A-A. In FIGS. 1 and 2, this NRD guide mode suppressor has a dielectric waveguide 1 sandwiched between parallel conductor plates 2*a* and 2*b* as shown in FIG. 2. The dielectric waveguide 1 is realized by Teflon®

(polytetrafluoroethylene) having a dielectric constant $\in r=2.04$ and a loss tangent tan δ of approximately $1.5\times10^{-4}$, and has a height a of 2.25 mm and a width b of 2.5 mm as shown in FIG. 2. Assuming that an operating frequency of an electromagnetic wave propagated through the dielectric waveguide 1 is 60 GHz, its wavelength λ is 5 mm, the height a is less than λ/2, and hence the electromagnetic wave having the operating frequency is not propagated between the conductor plates 2*a* and 2*b* other than the dielectric waveguide 1. On the other hand, in the dielectric waveguide 1, the wavelength λ is shortened, and the electromagnetic wave having the operating frequency can be propagated. As a result, in an operating frequency band, there is formed an NRD guide in which the electromagnetic wave is propagated through the dielectric waveguide 1 alone.

Here in FIG. 1, the dielectric waveguide 1 is configured to bend with a curvature radius R and, in this case, an electromagnetic wave in an LSE mode as a parasitic mode is generated besides an LSM mode which is the above-described operating mode. Here in FIGS. 1 and 2, when a metal body 3 as a conductor is provided in the vicinity of the dielectric waveguide 1, the LSE mode is suppressed. A distance d (FIG. 1) between this metal body 3 and the dielectric waveguide 1 may be zero, and an electromagnetic wave in the LSE mode is effectively suppressed if this distance is approximately 0.5 mm when the operating frequency is in a 60 GHz band. It is to be noted that the metal body 3 has an arbitrary shape and, the LSE mode suppression effect can be obtained even if various kinds of shapes such as a discoid shape, an elliptic shape, a prismatic shape and others are adopted.

Figure 3:
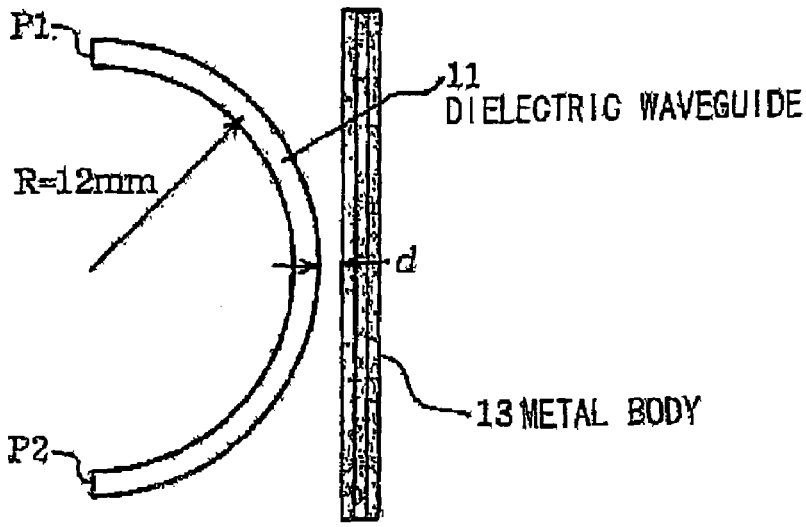
FIG. 3 is a view showing an example of the NRD guide mode suppressor depicted in FIG. 1.

FIG. 3 is a view showing a configuration of the NRD guide mode suppressor when the metal body 3 of FIGS. 1 and 2 is a rod-like metal body 13. A dielectric waveguide 11 corresponding to the dielectric waveguide 1 has a curvature radius R of 12 mm, a cross-sectional shape and a material which are the same as those of the dielectric waveguide 1 depicted in FIGS. 1 and 2. It is determined that the minimum distance between the metal body 13 and the dielectric waveguide 1 is a distance d. Furthermore, a cross-sectional shape of the metal body 13 is an H-like shape, and each side forming the H-like shape is λ/4.

Figure 4:
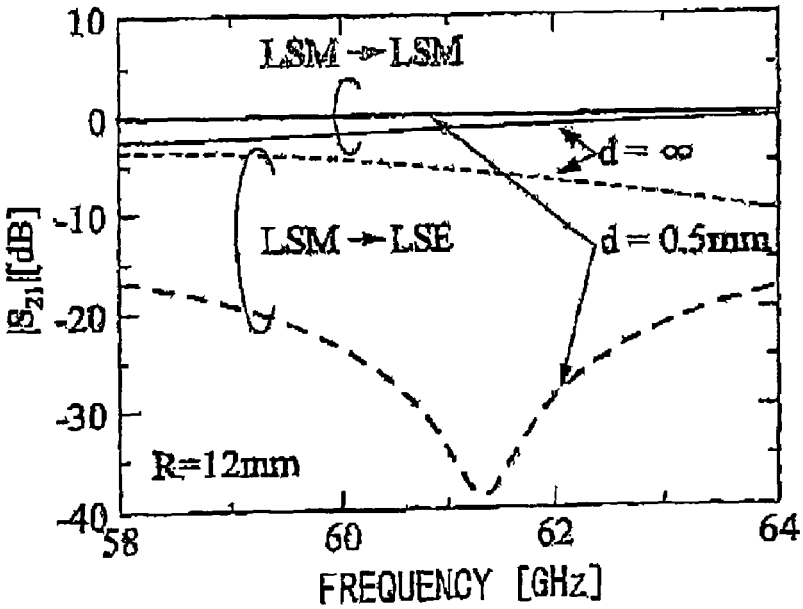
FIG. 4 is a view showing frequency dependence of an LSM mode and an LSE mode obtained by the NRD guide mode suppressor depicted in FIG. 3.

FIG. 4 is view showing frequency dependence (GHz) of output levels ($S_{21}$[dB]) in the LSM mode and the LSE mode which are output from a port P2 which is the other end of the NRD guide mode suppressor depicted in FIG. 3 when an electromagnetic wave in the LSM mode is input from a port P1 which is one end of the NRD guide mode suppressor. Here, FIG. 4 shows cases where R=12 mm and the distance d is 0.5 mm and where the distance d is infinite, i.e., ∞, where the metal body 13 is not provided. As shown in FIG. 4, when the metal body 13 is not provided, an LSM mode output is lowered particularly in a low frequency band, and occurrence of the LSE mode indicates a large value from −4 dB to −10 dB. On the other hand, when the metal body 13 is provided, the electromagnetic wave in the LSM mode input from the port P1 is output from the port P2 without substantially changing its level, and the generated LSE mode is suppressed to −15 dB or below, and further suppressed to approximately −40 dB in the vicinity of the operating frequency which is 61 GHz.

Figure 5:
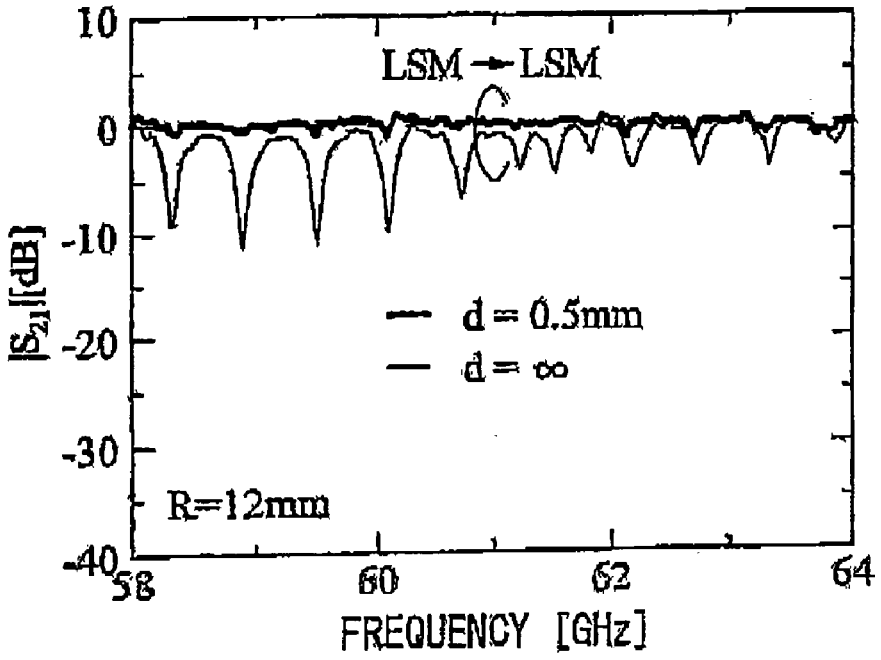
FIG. 5 is a view showing an experimental result of frequency dependence of the LSM mode obtained by the NRD guide mode suppressor illustrated in FIG. 3 and an NRD guide having no metal body provided thereto.

Moreover, FIG. 5 shows an experimental result of the LSM mode output which is output from the port P2 with respect to the LSM mode output which is input from the port 1 in the configuration illustrated in FIG. 3 where R=12 mm and the distance d is 0.5 mm and where the distance d is infinite, i.e., ∞, where the metal body 13 is not provided. As shown in FIG. 5, although the dependence ($S_{21}$[dB]) on the frequency (GHz) having a spike-like ripple is demonstrated when the metal body 13 is not provided, the substantially fixed frequency dependence with extremely reduced attenuations is demonstrated when the metal body 13 is provided and hence stable output characteristics can be obtained.

Figure 6:
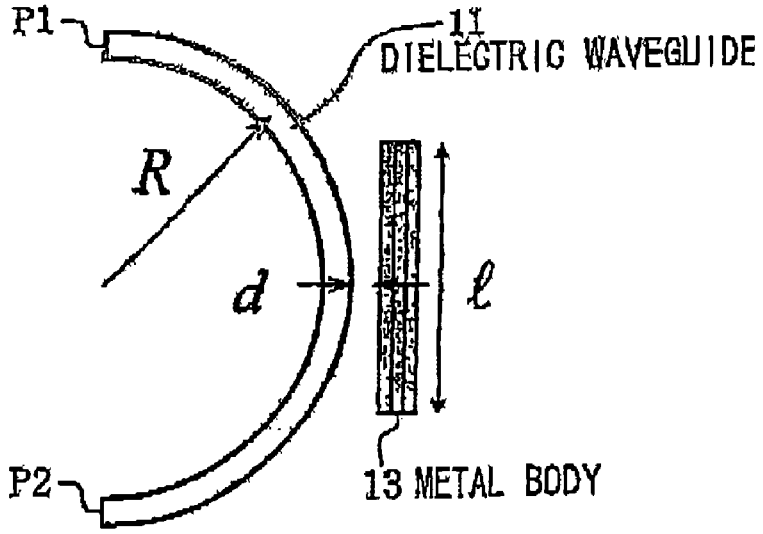
FIG. 6 is a schematic view showing a configuration of the NRD guide mode suppressor having a specified length of a metal body, which is the NRD guide mode suppressor illustrated in FIG. 3.
Figure 7:
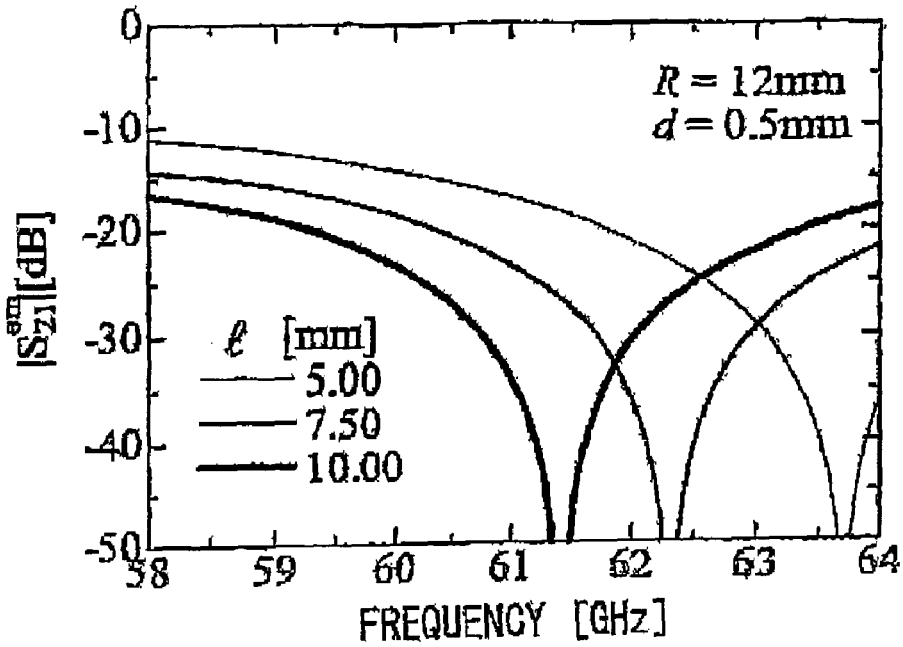
FIG. 7 is a view showing frequency dependence of the LSE mode when a length of the metal body is specified as a parameter in the NRD guide mode suppressor depicted in FIG. 6.

Here, when a length l of the metal body 13 in the NRD guide mode suppressor depicted in FIG. 3 is changed as shown in FIG. 6, an LSE mode output to be suppressed demonstrates such frequency dependence as shown in FIG. 7. FIG. 7 shows the dependence ($S_{21}$[dB]) on the frequency (GHz) where R=12 mm, d=0.5 mm at l=5.00 mm, 7.50 mm and 10.00 mm. That is, when the curvature radius R=12 mm and the distance d=0.5 mm of the dielectric waveguide 11 including ports P1 and P2 remain unchanged and the length l of the metal body 13 is sequentially changed to 5.00 mm, 7.50 mm and 10.0 mm, a minimal value of the LSE mode tends to sequentially shift to approximately 61.8 GHz, approximately 62.3 GHz and approximately 63.7 GHz. Therefore, the NRD guide mode suppressor can excellently suppress the LSE mode under the condition that the length 1 of the metal body 13 is set in accordance with the minimal value of the LSE mode corresponding to the operating frequency.

Figure 8:
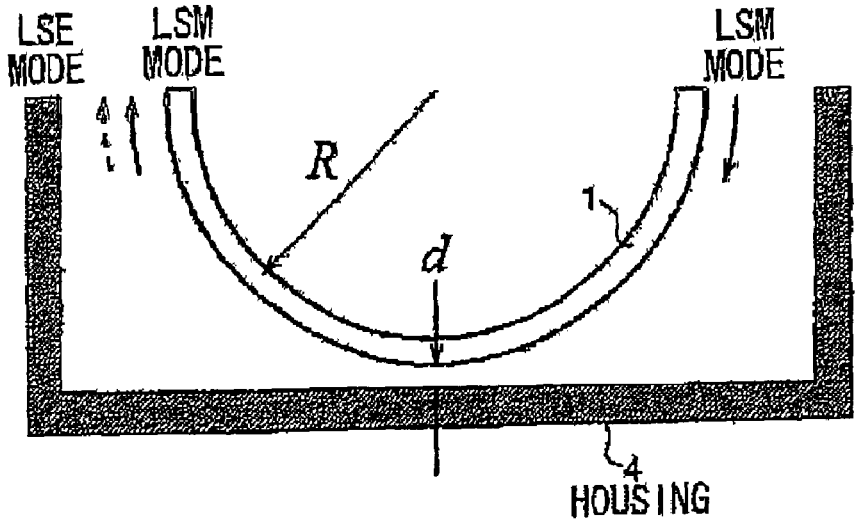
FIG. 8 is a view showing an example of an NRD guide mode suppressor in which a housing also serves as a metal body.

It is to be noted that the effect of suppressing the LSE mode can be obtained even though the above-described metal body 3 has an arbitrary shape, and hence the LSE mode can be also suppressed by arranging a housing 4 formed of a conductor which is a housing of the NRD guide to be closer to the bending dielectric waveguide 1 like the metal body as shown in, e.g., FIG. 8., which shows the LSM and LSE mode of the dielectric waveguide 1 at radius R and distance d in the housing 4. In this case, the housing 4 demonstrates an original function of the housing and a function of the metal body as a mode suppressor, thereby facilitating a reduction in size and weight of the NRD guide.

Embodiment 2

Embodiment 2 according to the present invention will now be described. In Embodiment 1 mentioned above, the LSE mode is suppressed when the dielectric waveguide 1 of the NRD guide is generally bent, but the LSE mode is suppressed in the NRD guide serving as a 3-dB coupler in this Embodiment 2.

Figure 9:
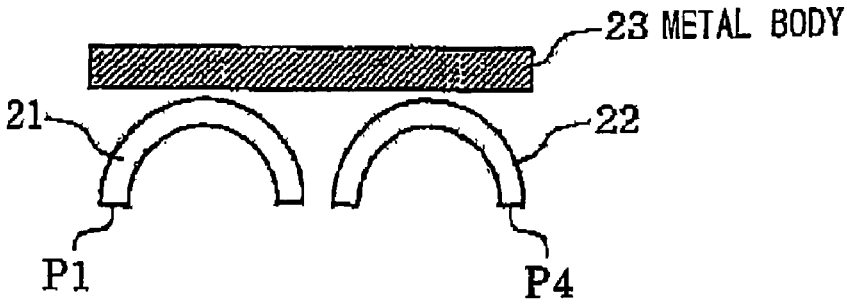
FIG. 9 is a schematic view showing a configuration of an NRD guide mode suppressor as a 3-dB coupler which is an embodiment according to the present invention.

FIG. 9 is a schematic view showing a configuration of an NRD mode suppressor applied to a 3-dB coupler which is Embodiment 2 according to the present invention. Referring to FIG. 9, in this 3-dB coupler, dielectric waveguides 21 and 22 having ends of curved semicircles on one side being close to each other are provided, an electromagnetic wave having an operating frequency input from a port P1 at the other end of the dielectric waveguide 21 is subjected to 3 dB coupling between the dielectric waveguides 21 and 22 which are in proximity to each other, and the electromagnetic wave having the operating frequency is output from a port P4 at the other end of the dielectric waveguide 22. Here, like Embodiment 1, when a metal body 23 corresponding to the metal body 13 is arranged in proximity to the both dielectric waveguides 21 and 22, the LSE mode propagated through the dielectric waveguides 21 and 22 is suppressed like Embodiment 1.

Figure 10:
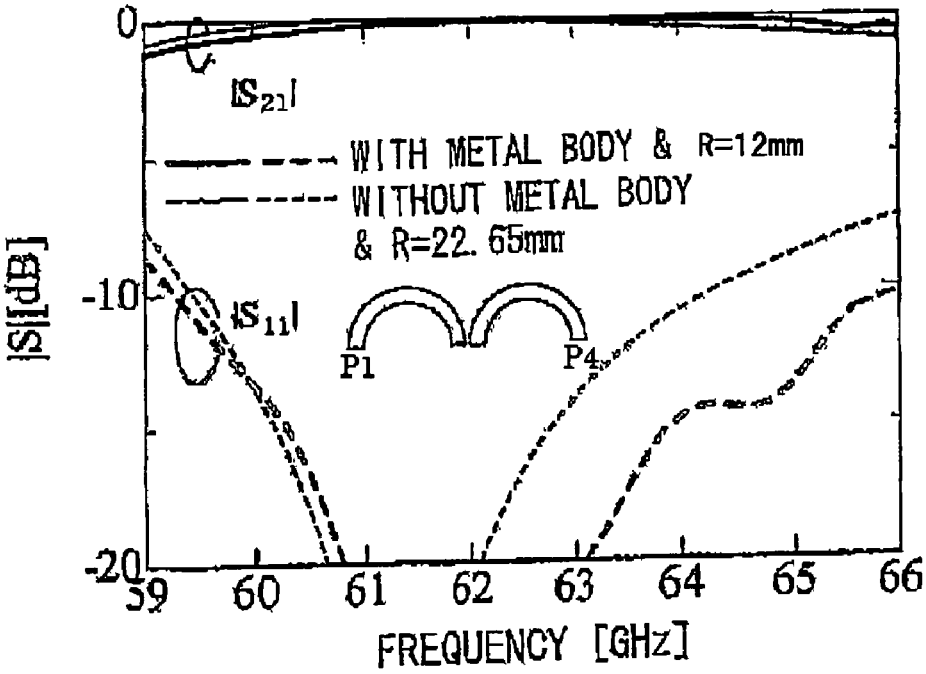
FIG. 10 is a view showing frequency dependence of transmission characteristics in case of the NRD guide mode suppressor depicted in FIG. 9 and in case of a counterpart having no metal body provided thereto.

FIG. 10 shows frequency dependence (S[db]) of reflection ($S_{11}$) at frequency (GHz) at the port P1 and an output ($S_{21}$) at the port P4 when the metal body 23 is arranged and when the metal body 23 is not arranged. That is with a metal body and R=12 mm and without a metal body and R=22.65 mm for ports P1 and P4. Here, although substantially the same frequency dependence is shown in both cases where the metal body 23 is arranged and where the metal body 23 is not arranged, a curvature radius R of each of the dielectric waveguides 21 and 22 is 12 mm when the metal body 23 is provided, whereas the curvature radius R of each dielectric waveguide is changed to 22.65 mm when the metal body 23 is not provided. That is, in case of acquiring transmission characteristics of the same reflection and output, providing the metal body 23 can reduce a length to ½ and an area to approximately ¼.

The curvature radius R of each dielectric waveguide can be reduced in this manner because the LSE mode generated at a bending portion is suppressed by provision of the metal body 23 as described above. As a result, the miniaturized 3-dB coupler can be realized. In this case, when the metal body 23 is used for side walls of a housing like Embodiment 1, a reduction in size and weight of the 3-dB coupler can be further facilitated.

Embodiment 3

Embodiment 3 according to the present invention will now be described. This Embodiment 3 realizes an NRD guide mode suppressor which can completely reproduce an input LSM mode while suppressing an LSE mode.

Figure 11:
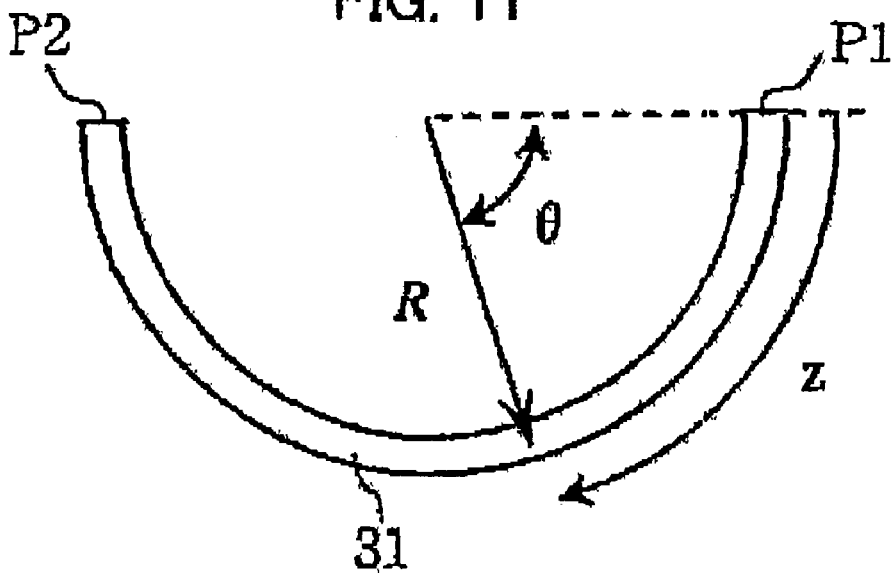
FIG. 11 is a view showing a dielectric wavguide forming part of the NDR guide mode suppressor according to the third embodiment of the present invention.

First, an operation principle of this Embodiment 3 will be explained. Considering such a dielectric waveguide 31 of an NRD guide as shown in FIG. 11, it is assumed that an electromagnetic wave having an operating frequency is input from a port P1 at one end of the dielectric waveguide 31, propagated in the dielectric waveguide 31 and output from a port P2 at the other end. Additionally, it is assumed that a curvature radius of this dielectric waveguide 31 is R, an angle from the port P1 to a predetermined position on the dielectric waveguide 31 is θ, and a distance from the port P1 to the predetermined distance on the dielectric waveguide 31 is z.

The electromagnetic waves input to the port P1 are propagated in a state where both the LSM mode and the LSE mode exist and, assuming that the electromagnetic waves of the respective modes are $a_1(z)$ and $a_2(z)$, amplitudes $|a_1(z)|$ and $|a_2(z)|$ of the respective electromagnetic waves in the LSM mode and the LSE mode can be represented as the following expressions (1) and (2)

$$|a_1(z)|=\sqrt{(\cos^2(\Gamma\cdot z/2)+(\Delta\beta/\Gamma)^2\cdot\sin^2(\Gamma\cdot z/2))} \quad (1)$$

$$|a_2(z)|=(2\cdot c/\Gamma)|\sin(\Gamma\cdot z/2)| \quad (2)$$

where $$\Gamma=\sqrt{(4c^2+\Delta\beta^2)} \quad (3)$$

Here, z is a propagation length on a bend, c is a mode coupling coefficient, and Δβ is a phase constant difference between the LSM mode and the LSE mode.

Figure 12:
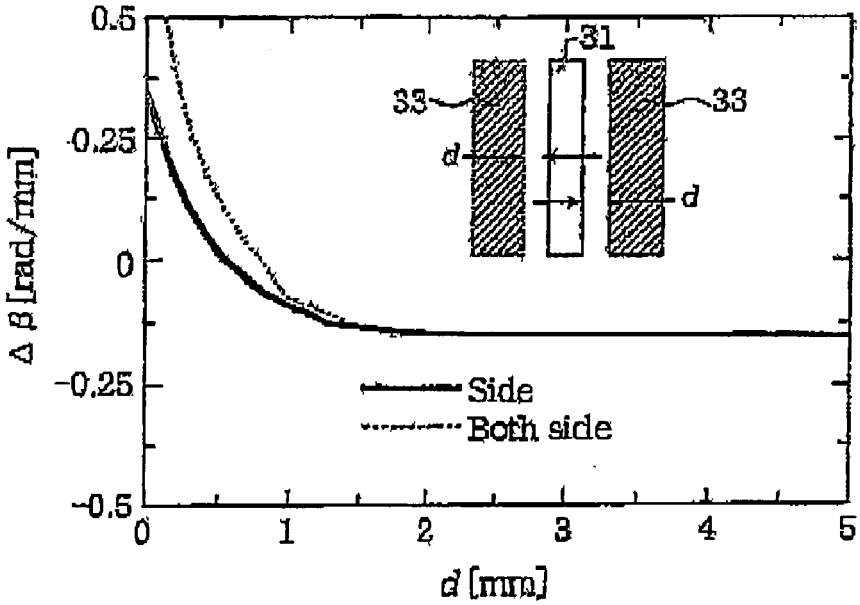
FIG. 12 is a view showing gap dependence of a dielectric waveguide and a metal body with respect to a phase constant difference.

The following description is directed to the case that the dielectric waveguide 31 made of Teflon® (polytetrafluoroethylene) and shown in FIG. 12 has a width of 2.5 mm and a height of 2.25 mm. FIG. 12 shows the phase constant difference Δβ as a function of distance d (mm) at a side and both sides of the metal body 33 and the dielectric waveguide 31. In FIG. 12, the character "d" is intended to indicate a distance between the dielectric waveguide 31 and each metal body 33. From the calculation result of the phase constant difference Δβ between the LSM mode and the LSE mode to the distance "d" shown in FIG. 12, it will be understood that the phase constant difference Δβ is reduced as the distance d is increased. Here, a remarkable point is that the phase constant difference Δβ becomes zero when the distance d is 0.5 mm. At this time, the above-described expressions (1) and (2) become simple expressions represented as the following expressions (4) and (5).

$$|a_1(z)|=|\cos(c\cdot z)| \quad (4)$$

$$|a_2(z)|=|\sin(c\cdot z)| \quad (5)$$

Here, since it is theoretically known that the mode coupling coefficient c is in inverse proportion to the curvature radius R and the distance z is in proportion to the curvature radius R, the following expressions (6) and (7) can be obtained.

$$c=c_0/R \ (c_0\text{: a constant}) \quad (6)$$

$$z=R\cdot\theta \quad (7)$$

Thus, when these expressions (6) and (7) are assigned in the expressions (4) and (5), the following expressions (8) and (9) can be obtained.

$$|a_1(z)|=|\cos(c_0\cdot\theta)| \quad (8)$$

$$|a_2(z)|=|\sin(c_0\cdot\theta)| \quad (9)$$

The same result can be also obtained by sandwiching the dielectric waveguide 31 between the two metal bodies 33 as shown in a left-hand inserted view of FIG. 12, Δβ in this example is as indicated by a broken line in the same drawing, and a gap with which Δβ=0 can be achieved is 0.8 mm.

Based on these expressions (8) and (9), the respective amplitudes of the LSM mode and the LSE mode do not concern the curvature radius R at all. That is, the curvature radius R does not relate to a design at all and can be arbitrarily determined. That is, even if the dielectric waveguide has any curvature radius, the LSM mode can be reproduced by providing a given fixed angle, i.e., a unity coupling angle θo.

Figure 13:
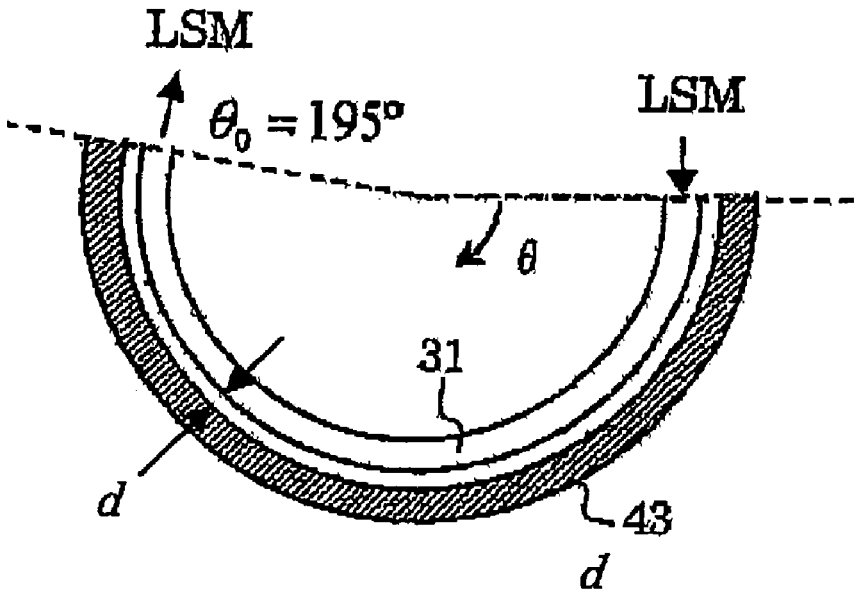
FIG. 13 is a view showing an example of an NRD guide mode suppressor which realizes a unity coupling angle at which a phase constant difference becomes zero.
Figure 14:
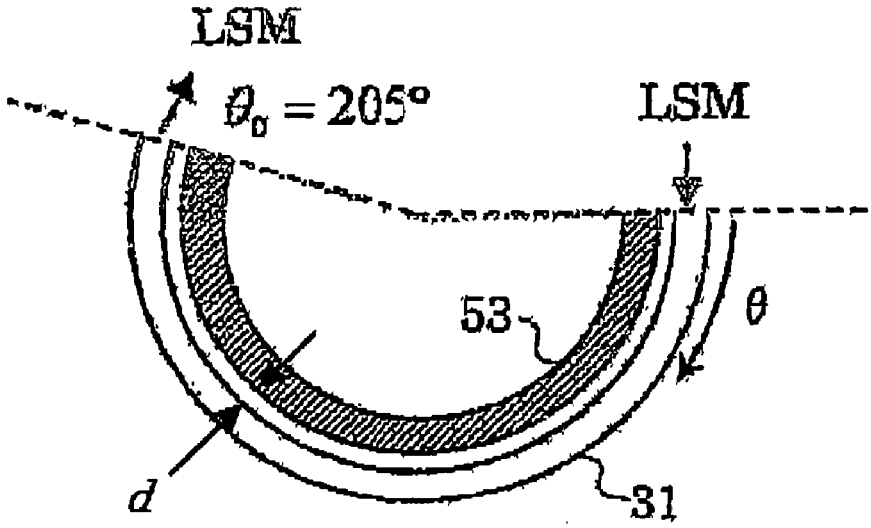
FIG. 14 is a view showing another example of the NRD guide mode suppressor which realizes the unity coupling angle at which the phase constant difference becomes zero.

FIGS. 13 and 14 show examples of NRD guide mode suppressors having metal bodies 43 and 53 provided thereto in such a manner that the phase constant difference Δβ=0 can be achieved in the LSM mode for dielectric waveguide 31, and a unity coupling angle θo is 195° in FIG. 13 whilst a unity coupling angle θo is 205° in FIG. 14. It is to be noted that FIG. 13 shows an example where the metal body 43 is attached on the outer side of the dielectric waveguide 31 and FIG. 14 shows an example where the metal body 53 is attached on the inner side of the dielectric waveguide 31. Incidentally, although a bending curvature exceeding 180° is consequently demonstrated in this case, it is good enough to change the distance d to adjust the phase constant difference Δβ by using the relationship shown in each of FIG. 12 and finally effect optimization when the NRD guide mode suppressor shown in FIGS. 13 and 14 is bent at 180°. Further, the dielectric waveguide having an arbitrary bending angle can be likewise optimized by changing the distance d to adjust the phase constant difference Δβ.

Figure 15:
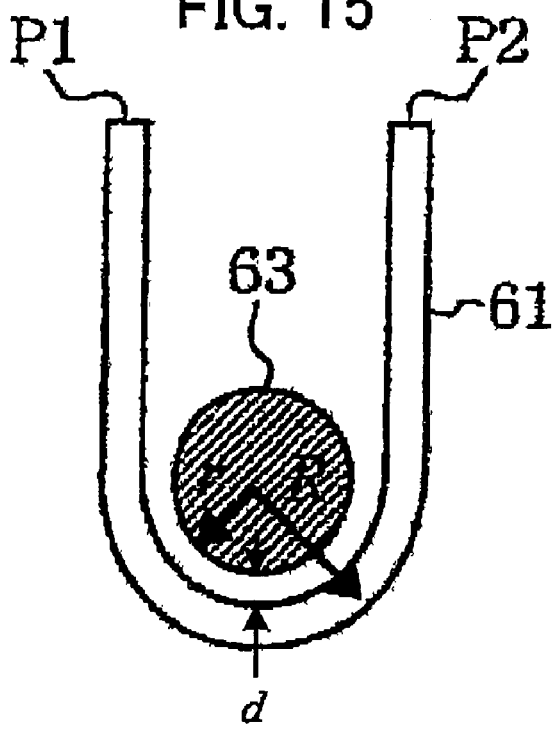
FIG. 15 is a schematic view showing a configuration of the NRD guide mode suppressor which is Embodiment 3 according to the present invention.

For example, it is possible to realize such an NRD guide mode suppressor having a bending angle of 180° as shown in FIG. 15, which shows a dielectric waveguide 61 with ports P1 and P2 and a metal body 63. That is, a discoid metal body 63 having a radius r is provided on the inner side of a dielectric waveguide 61 which has an arbitrary curvature radius R and bends at 180°, and a distance d between the metal body 63 and the dielectric waveguide 61 can be changed by varying this radius r, thereby adjusting a phase constant difference Δβ. In FIG. 15, the LSM mode can be reproduced by setting the distance d to approximately 1 mm. It is to be noted that, when the metal body 63 is not provided, the LSE mode is produced, and hence utilization is impossible.

Figure 16:
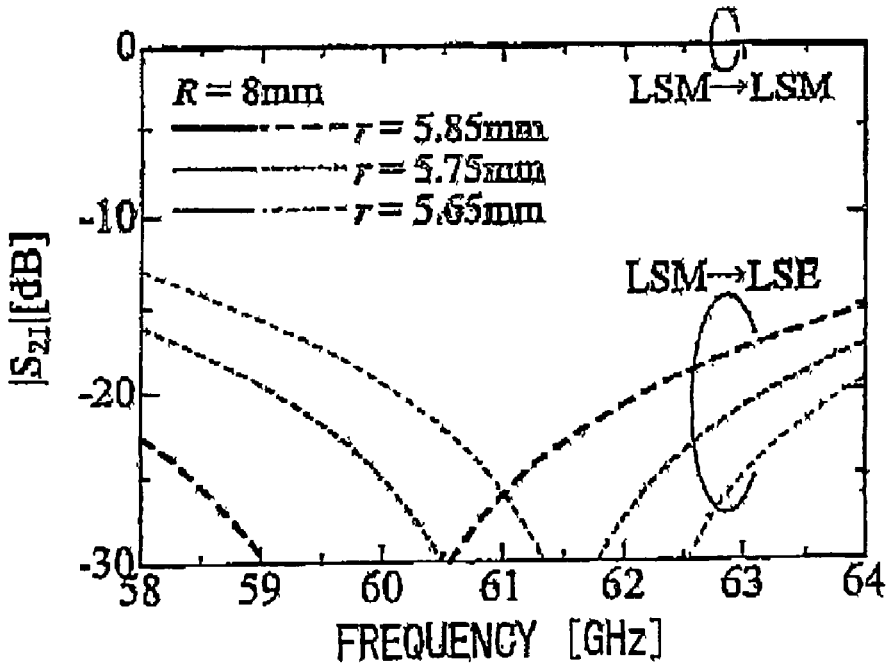
FIG. 16 is a view showing frequency dependence of the LSM mode and the LSE mode when a distance between the dielectric waveguide and the metal body is specified as a parameter in the NRD guide bend suppressor depicted in FIG. 15.
Figure 17:
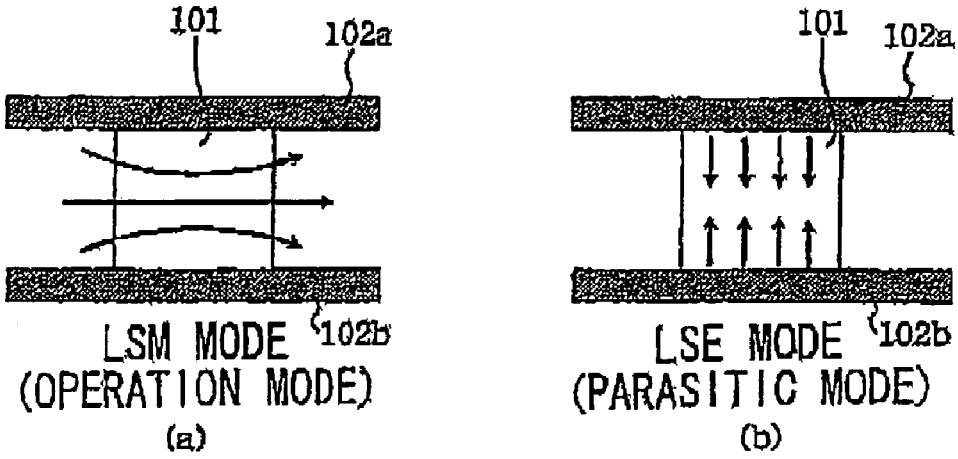
FIG. 17 PRIOR ART
FIG. 17 is a view showing electric field distributions of the LSM mode and the LSE mode.
Figure 18:
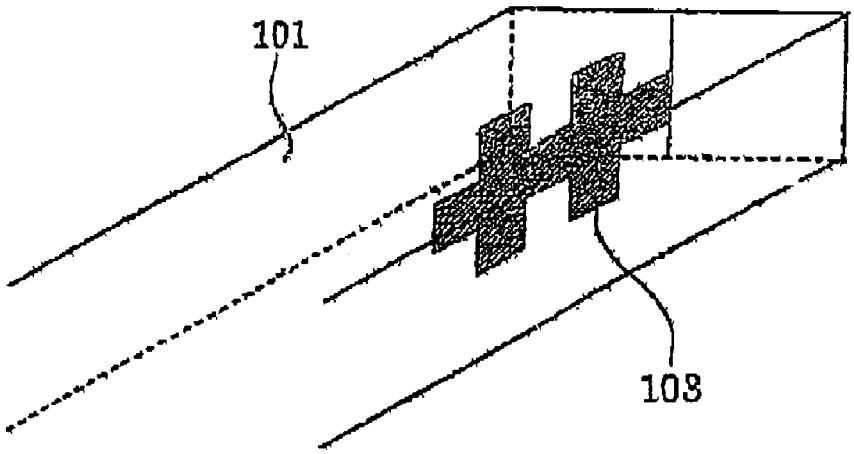
FIG. 18 PRIOR ART
FIG. 18 is a perspective view showing a configuration of an NRD guide using a conventional mode suppressor.

Furthermore, in this case, when the radius r is changed, consequently the distance d is changed as shown in FIG. 16, a frequency of a minimal value in the LSE mode can be shifted, thereby realizing an NRD guide mode suppressor capable of effectively suppressing the LSE mode. FIG. 16 shows the dependence (S21[db]) as a function of frequency (GHz) for LSM→LSE and LSE→LSM modes at R=8, 5.85, 5.75 and 5.65 mm.

It is to be noted that the description has been given as to the metal bodies 3, 13, 23, 33, 43, 53, and 63 in Embodiments 1 to 3, but the present invention is not restricted thereto, and any conductor can be used.

INDUSTRIAL APPLICABILITY

According to the present invention, it is possible to obtain an advantage of effectively suppressing an LSE mode which is an unnecessary parasitic mode by the simple external arrangement alone, i.e., arranging a conductor in the vicinity of a dielectric waveguide of an NRD guide which transmits an electromagnetic wave through the dielectric waveguide which is sandwiched between parallel conductor plates and has a gap which is less than a ½ wavelength.

Moreover, according to the present invention, when the conductor is a housing of an apparatus including the NRD guide, effects and advantages of both a housing function and a mode suppressing function can be obtained, thereby facilitating a reduction in size and weight.

Additionally, according to the present invention, when the conductor is provided in the vicinity of a directional coupler formed of dielectric waveguides which are in proximity to each other and bent, a bending radius of a bending portion can be reduced, thereby obtaining the direction coupler reduced in size and weight.

Further, according to the present invention, the conductors are provided along the dielectric waveguide at equal intervals in proximity to each other, a curvature radius of a bending portion of the dielectric waveguide is arbitrary, and an amplitude of an electromagnetic wave propagated through the dielectric waveguide is determined based on an angle of the bending portion, thereby obtaining an advantage of assuredly reproducing an LSM mode.

Furthermore, according to the present invention, since a phase constant difference of an electromagnetic wave propagated through the dielectric waveguide is adjusted by changing a distance between the dielectric waveguide and the conductor, a bending portion having an arbitrary bending angle can be acquired, thus obtaining an advantage of realizing a flexible NRD guide.

Moreover, according to the present invention, a phase constant difference in an NRD guide having a standard shape can be set to zero by determining a distance between the dielectric waveguide and the conductor as approximately 0.5 mm, thereby obtaining an advantage of reproducing an LSM bend at an output port of a bend.

Additionally, according to the present invention, the conductor has a rod-like shape, a length of the metal body is changed to vary a suppressed frequency of a parasitic mode generated in the dielectric waveguide, or the dielectric waveguide forms a bending portion of approximately 180 degrees, the conductor is provided on the inner side of the bending portion, and a curvature radius of the conductor is changed to vary a suppressed frequency of a parasitic mode generated in the dielectric waveguide, thereby acquiring an advantage of effectively suppressing an operating frequency as a suppression target.

The invention claimed is:

1. A small NRD guide bend, comprising:

an NRD guide configured to allow electromagnetic waves to propagate through a dielectric strip sandwiched between conducting plates parallel to each other, wherein a spacing between the conducting plates is less than half a wavelength of the electromagnetic wave, and the dielectric strip is in a vicinity of a metal block.

2. The small NRD guide bend according to claim 1, wherein the metal block is a part of a housing for the NRD guide.

3. The small NRD guide bend according to claim 1, wherein the dielectric strip has a curved portion, the metal block has also a curved portion along the dielectric strip, a curvature radius of the metal block is adjusted to control the resonant frequency of the parasitic mode to be suppressed in the NRD guide.

4. The small NRD guide bend according to claim 1, wherein a gap between the dielectric strip and the metal block is approximately 0.5 mm in width.

5. The small NRD guide bend according to claim 1, wherein the metal block has a rectangular cross section, and a length of the metal block is adjusted to control the resonant frequency of the parasitic mode to be suppressed in the NRD guide.

6. A small NRD guide bend, comprising:

an NRD guide configured to allow electromagnetic waves to propagate through a dielectric strip sandwiched between conducting plates parallel to each other, wherein a spacing between the conducting plates being less than half a wavelength of the electromagnetic wave, and the dielectric strip is in the vicinity of a couple of metal blocks.

7. The small NRD guide bend according to claim 6, wherein gaps between the dielectric strip and the metal blocks are adjusted to control the phase constant of the electromagnetic wave propagating through the dielectric strip.

8. The small NRD guide bend according to claim 6, wherein a gap between one of the metal blocks and the dielectric strip is substantially equal to a gap between the other of the metal blocks and the dielectric strip in width.

9. A small NRD guide bend, comprising:

an NRD guide directional coupler constructed by a couple of dielectric strips sandwiched between conducting plates parallel to each other, wherein a spacing between the conducting plates is less than half a wavelength of the electromagnetic wave, the dielectric strips are in the vicinity of a metal block.

* * * * *